US005973443A

United States Patent [19]

Chang et al.

[11] Patent Number: 5,973,443

[45] **Date of Patent: *Oct. 26, 1999**

[54] SPARK PLUG ELECTRODE TIP FOR INTERNAL COMBUSTION ENGINE

[75] Inventors: Chin-Fong Chang, Morris Plains; Michael Sean Zedalis, Mendham, both of N.J.; Richard Dale Taylor, Findlay, Ohio; Edgar Arnold Leone, Randolph, N.J.

[73] Assignee: AlliedSignal Inc., Morristown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/642,975

[22] Filed: May 6, 1996

[51] Int. Cl.[6] ..... H01T 13/39

[52] U.S. Cl. ..... 313/141; 313/144

[58] Field of Search ..... 313/141, 144; 123/169 EL; 252/514, 520

[56] References Cited

U.S. PATENT DOCUMENTS

| | | | |
|---|---|---|---|
| Re. 35,429 | 1/1997 | Kondo | 313/141 |
| 3,548,472 | 12/1970 | Urushiwara et al. | 313/141 X |
| 3,691,419 | 9/1972 | Van Uum et al. | 313/138 |
| 3,803,892 | 4/1974 | Yamaguchi | 445/7 |
| 3,857,145 | 12/1974 | Yamaguchi et al. | 313/141 X |
| 3,958,144 | 5/1976 | Franks | 313/141 X |
| 4,324,588 | 4/1982 | Zusk et al. | 313/141 X |
| 4,540,910 | 9/1985 | Kondo et al. | 313/141 X |
| 4,705,486 | 11/1987 | Meyers et al. | 445/7 |
| 4,743,793 | 5/1988 | Toya et al. | 313/141 |
| 4,771,209 | 9/1988 | Ryan | 313/140 |

FOREIGN PATENT DOCUMENTS

| | | |
|---|---|---|
| 101869 | 4/1993 | Japan . |
| 0479540 | 2/1938 | United Kingdom . |

*Primary Examiner*—Ashok Patel

[57] ABSTRACT

A spark plug electrode wire composed of an iridium-rhodium alloy exhibits improved erosion resistance and enhanced durability in leaded and unleaded fuel environments. The alloy is formed into a wire having high thermal conductivity, low electrical resistivity, good oxidation resistance, good corrosion resistance, good wear resistance. It exhibits desirable work function in pure metals and alloys such as iridium and iridium-rhodium. The wire is inserted into the center electrode of the spark plug and brazed to an Inconel base metal and copper core thereof using a silver-based brazing alloy. After electrical engine dynamometer testing for 200 hours, an improvement in erosion resistance as high as eight fold was observed with an 60% iridium-40% rhodium alloy, when compared to a conventional 90% platinum-10% nickel alloy. The iridium-rhodium spark plug electrode wire can be used to minimize erosion and wear resistance in leaded and unleaded fuel environments.

12 Claims, 7 Drawing Sheets

SPARK PLUG ELECTRODE TIP FOR INTERNAL COMBUSTION ENGINE

BACKGROUND OF THE INVENTION

1. Field of the Invention

This invention relates to materials and methods of manufacturing spark plug electrode tips which provide substantially improved erosion resistance and enhanced durability of spark plugs in both leaded and unleaded fuel environments for internal combustion engines.

2. Brief Description of the Prior Art

Spark plugs are used in internal combustion engines to ignite fuel in a combustion chamber. The electrodes of a spark plug are subject to intense heat and an extremely corrosive atmosphere generated by the formation of a spark and combustion of the air/fuel mixture. To improve durability and erosion resistance, the spark plug electrode tips must be able to withstand the high temperature and corrosive environment of the internal combustion chamber resulting from the chemical reaction products between air, fuel and fuel additives.

SAEJ312 describes the specification for automotive gasoline used as a fuel in the United States. The gasoline consists of blends of hydrocarbons derived from petroleum: saturates (50–80%), olefins (0–15%), and aromatics (15–40%). Leaded gasoline contains about 0.10 g Pb/gallon fuel (0.026 g Pb/L), and 0.15% sulfur. In unleaded gasoline there is about 0.05 g Pb/gallon, (0.013 g Pb/L), 0.1% sulfur, 0.005 g P/gallon, (0.0013 g P/L). In addition, there are a number of additives incorporated into the fuel for various reasons. For example, tetramethyllead (TML) and tetraethyllead (TEL) are added as antiknock agents. Carboxylic acids (acetic acid), compounds are added as lead extenders. Aromatic amines, phenols are added as antioxidants. Organic bromine, chlorine compounds are added as scavengers and deposit modifiers. Phosphors and boron containing compounds are added to reduce surface ignition, preignition and as engine scavengers. Metal deactivators are added to reduce oxidative deterioration of the fuel by metals, such as Cu, Co, V, Mn, Fe, Cr and Pb. In addition, carboxylic acids, alcohols, amines, sulfonates, phosphoric acid salts of amines, are used as rust-preventing additives.

The mechanism for ignition in an internal combustion engine is very complex and is briefly discussed here. In the gasoline engine, the rising piston compresses the fuel/air mixture, causing increases in pressure and temperature. The spark ignites the fuel-air charge, and the force of the advancing flame front acts against the piston, compressing the unburned fuel-air charge further. Preflame combustion reactions occur in the unburned fuel-air mixture. The pinging noise or knock often associated with internal combustion engines is produced when an extremely rapid combustion reaction occurs in the end gas ahead of the advancing flame front. The formation of the preflame reaction products of the gasoline sets the stage for knock. It is believed that the alkyllead additive must first decompose in the combustion chamber to form lead oxide before it can exert its antiknock effect. The antiknock species must be finely dispersed in the combustion chamber so that adequate numbers of collisions of the critical reacting species with the antiknock agent will occur. However, lead oxide deposits can cause problems of valve burning and spark plug fouling. Lead deposits which accumulate on the spark plug insulator cause engine misfiring at high speed due to the relatively high electrical conductivity of the deposit.

The complete combustion of a hydrocarbon fuel with air will produce carbon dioxide ($CO_2$), water ($H_2O$) and nitrogen ($N_2$). The ratio of air to fuel by weight, 14.5/1, is the chemically correct mixture ratio. When less air is available, some carbon monoxide (CO) and hydrogen ($H_2$) are found in the products, whereas if excessive air is available some oxygen ($O_2$) is found in the products. The atmosphere present during the combustion may cause the hot corrosion of electrodes in the spark plug.

The manufacture of copper (Cu) and nickel (Ni) electrodes for spark plugs is a proven art and has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps, inserting a piece of copper wire into the cup and then lightly pressing the two materials together. U.S. Pat. No. 3,857,145 issued Dec. 31, 1974 and entitled "Method of Producing Spark Plug Center Electrode" discloses a process whereby a copper center core is inserted into a nickel member and attached thereto by a collar portion to assure that an electrical flow path is produced.

The spark plug electrodes produced by the methods disclosed above perform in a satisfactory manner for a relatively short period of driving time when used in vehicles that were manufactured prior to the implementation of the clean air act of 1977 in the United States. After 1977, with modifications to engine and fuel, the operating temperature of most vehicle increased. As a result of the changes in the engines and fuels, some of the operating components in engines have been subjected to the corrosive effects of the exhaust gases. After a period of time of operating at higher temperatures in recirculation gases, some corrosion/erosion can occur at the nickel-based center electrode. Once corrosion has taken place, the electrical flow path deteriorates which can result in lower fuel efficiency.

U.S. Pat. No. 4,705,486 issued Nov. 10, 1987, and entitled "Method for Manufacturing a Center Electrode for a Spark Plug," discusses a method for manufacturing a center electrode in order to provide some degree of longevity of the spark plug. The center electrode is made from a good heat conducting material such as copper surrounded by a jacket of a corrosion resistant material such as nickel.

This invention also provides a method of manufacturing an electrode for a spark plug whereby a platinum tip is attached to a body composed of a nickel alloy such as Inconel (a registered trademark of International Nickel Company) nickel alloy (e.g., Inconel) body in which a copper core is located. In this process, a blank is cut from a roll of Inconel wire and the end face squared to produce a flat surface. A strip of platinum is welded to the flat surface and a chamfer surface is produced on the first end to remove any flash remaining from the weld and produce a platinum tip. The blank is placed in a die and extruded to produce a cylindrical bore. As the extrusion takes place, the platinum flows down the chamfer to completely cover the weld. A copper core is inserted in the cylindrical core such that there is an electrical flow path produced between the platinum tip and copper core through the Inconel body. The platinum tip is resistant to the corrosive component in a combustion chamber and maintains an electrical flow path between a copper core and a ground. The platinum is extruded to cover the weld to assure that the flow path does not deteriorate under normal operating temperatures.

Platinum as an electrode tip base alloy is a preferred candidate material due to the fact that it resists oxidation and has been proven to greatly increase the service life of a spark plug. This design, including a platinum tip has increased the service life of spark plugs at least a factor of two over standard spark plugs, not incorporating a platinum electrode tip. However, the platinum tip must be used in the unleaded fuel environment. In the leaded fuel environment, lead oxide may react upon heating with $H_2$, B, K, CaC, Na, C and CO and reduce to metallic lead. Metallic lead may attack platinum tip to form a low melting eutectic. The local melting of platinum will reduce the durability of spark plug. Platinum is also a very expensive metal which significantly impacts the final cost of a spark plug. Currently, platinum is selling in the range of $380 US dollars per troy ounce.

The life of a spark plug is improved by joining a heat-resistant and wear-resistant layer of platinum to the spark-discharge end of the center electrode which is made of Inconel. Resistance welding is used to minimize wear of the spark discharge end of the center electrode. However, the joint between the platinum tip and center electrode base metal often becomes cracked and oxidized. In certain cases, the platinum tip falls off at the position of this cracked and oxidized interfacial boundary. This phenomenon is considered to be largely due to thermal fatigue stress caused by the difference in linear expansion coefficients between platinum and Inconel. As a result of the varying operating loads of the engine, the spark plug is alternately and repeatedly subjected to high and low temperatures. Owing to this alternate repetition of high and low temperatures and to the difference in linear expansion coefficients, the joint between the discharging layer and the center electrode is repeatedly subjected to the thermal stress which results in the formation of transverse cracking.

U.S. Pat. No. 4,540,910 issued on Sep. 10, 1985, entitled "Spark Plug for Internal-Combustion Engine," recognizes this shortcoming and discloses a method of using a thermal stress relieving layer disposed between the discharging layer and the base metal of the center electrode. The thermal stress relieving layer is made of a platinum base alloy containing nickel, which is also present in the base metal. The discharging layer may be made of a material consisting essentially of 70 to 90 wt. % platinum and 30 to 10 wt. % iridium. The thermal stress relieving layer may be made of a material consisting essentially of 5 to 95 wt. % platinum and 95 to 5 wt. % nickel. Another platinum-containing wear-resistant layer may be provided on the other electrode. The wear-resistant layer is made of a material consisting essentially of 5 to 60 wt. % nickel and 95 to 40 wt. % platinum. However, at high temperatures under oxidizing atmosphere, the selective oxidation of nickel in platinum-nickel alloys may occur which will produce a porous oxide layer. This oxide layer may be removed by spark discharge. The combination of selective oxidation and material removal by spark erosion will significantly reduce the life of a spark plug.

There is still a need to develop a long-life non-platinum alloy and manufacturing method for spark plugs electrodes used in internal combustion engines in leaded and unleaded fuel environments.

SUMMARY OF THE INVENTION

The present invention provides an alloy that is especially suited for manufacture of a spark plug electrode tip. The alloy consists essentially of 60% iridium-40% by weight rhodium and forms within the spark plug a wire culminating in the electrode tip thereof. Spark plug electrode tips formed of the 60% iridium-40% rhodium alloy exhibit high thermal conductivity, low electrical resistivity, good oxidation resistance, good corrosion resistance and low work functions. In combination, these properties markedly improve the erosion resistance and durability of spark plugs in both leaded and unleaded fuel environments for internal combustion engines. Spark plugs manufactured with 60% iridium-40% rhodium electrode tips of the present invention exhibit corrosion resistance as much as eight times greater than spark plugs having electrode tips constructed from conventional 90% platinum-10% nickel alloys. The significant improvement in corrosion resistance is afforded whether the spark plug is used in a leaded or unleaded fuel environment.

BRIEF DESCRIPTION OF THE DRAWINGS

The invention will be more fully understood and further advantages will become apparent when reference is made to the following detailed description of the preferred embodiment of the invention and the accompanying drawings, in which.

DETAILED DESCRIPTION OF THE INVENTION

Figure 1:
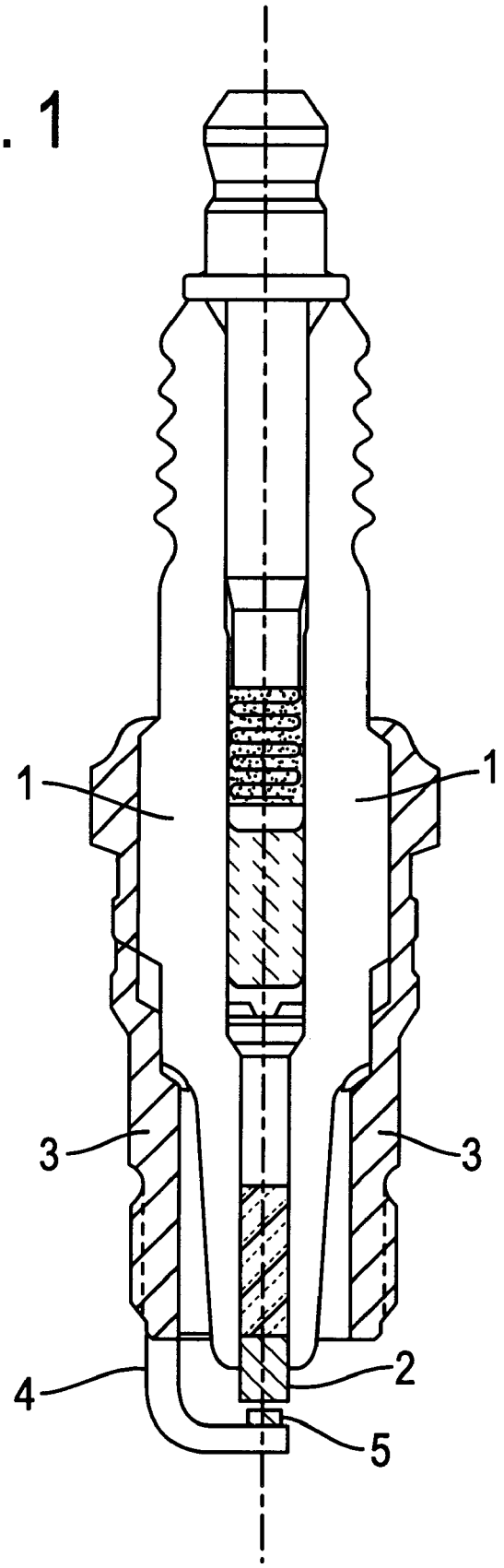
FIG. 1 depicts a spark plug for an internal combustion engine

The present invention provides a spark plug having an electrode tip composed of an alloy especially tailored for use therein. As used herein the term Ir-40% Rh means 60% iridium-40% rhodium and the term Pt-10% Ni means 90% platinum-10% nickel. Spark plugs manufactured with electrode tips composed of the alloy of this invention exhibit improved erosion resistance and enhanced electrode tip durability in both leaded and unleaded fuel environments used in internal combustion engines. Referring to FIG. 1, a spark plug is shown having an insulator shell 1, a center electrode 2 having one end protruding from the insulator shell, a metal shell 3 exterior to the insulator shell, a side ground electrode 4, and a noble metal tip 5 on the center electrode 2. The electrode tip 5 comprises a wire composed of an 60% iridium-40% rhodium alloy which exhibits high thermal conductivity, low electrical resistivity, good oxidation resistance, good corrosion resistance, good wear resistance, and low work function. Preferably, the erosion resistant electrode tip alloy has the following high temperature properties:

Thermal conductivity at 1200° K with the value ranging from 0.7 to 1.5 W/cm.K;

Work function with the value ranging from 4.5 to 5.4 eV;

Electrical resistivity at 900° K with the value <35 micro ohm.cm;

Melting point >1273° K;

Weight loss at 1273° K with the value <0.5 mg/cm$^2$hr;

Tensile strength at 1273° K with the value >100 MPa;

No low-melting eutectic phase formed with lead.

The wire comprising the electrode tip alloy of the invention can be made by casting, hot working and hot drawing, or by conventional powder metallurgy techniques. During assembly of the spark plug, the wire is inserted into the center electrode and brazed with the copper core using a silver-based brazing alloy. The wire can also be joined with Inconel by resistance welding or laser welding. After electrical engine dynamometer testing for 200 hours, an improvement of 8 times in erosion resistance as compared to 90% platinum-10% nickel alloy has been achieved in 60% iridium-40% rhodium alloy. The alloy does not form a low melting eutectic with lead. Advantageously, the electrode tip alloy can be used to improve resistance to oxidation, erosion and wear in leaded and unleaded fuel environments.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES 1–6

Alloys formed into the wire (0.032" diameter) of the invention for a spark plug electrode tip are listed in Table 1:

TABLE 1

Materials for Spark Plug Electrode Tip.

| Example Number | Material |
|---|---|
| 1 | Pure Pt |
| 2 | Pure Ir |
| 3 | Pure Ru |
| 4 | Pure Ag |
| 5 | Pure W |
| 6 | Ir-40 % Rh |
| Standard | Pt-10 % Ni |

EXAMPLES 7–30

About 0.032" diameter hole was drilled into the Inconel center electrode into copper core. Candidate electrode wire as listed in Table 1, example numbers 1 to 6 (including a standard) were then inserted into the center electrode and in contact with the copper core. Brazing was applied to join the tip and copper by using Sivaloy brazing alloy-35 (35% Ag-26% Cu-21% Zn-18% Cd) at the temperature above the solidus temperature (607° C.), or liquidus temperature (702° C.) or between the solidus and liquidus temperature to achieve the best bonding between the candidate electrode tip and copper core. The tip height and width was adjusted to be the same dimension as a commercially available fine wire electrode (0.032" diameter, and 0.040" long) found on an Autolite™ long-life fine wire spark plug. After fabricating, the joint was x-rayed to check its integrity and make sure that it was free of porosity or cracks. The "as prepared" electrode tips were analyzed by SEM before dynamometer testing to measure spacial characteristics (e.g., height, width, curvature of the corners, etc.). The brazed center electrodes were then assembled into a spark plug body using commercial processes.

The spark plugs were then subjected to electrical engine dynamometer testing for 200 hours. The candidate plugs were placed in cylinders 1 (positive polarity) and 3 (negative polarity) at the intake and exhaust valve positions of the engine dynamometer. Note: each cylinder contains two spark plugs. Commercial Autolite™ fine wire spark plugs (with Pt-10% Ni electrodes, were placed in cylinders 2 (positive polarity) and 4 (negative polarity) at the intake and exhaust valves for comparison.

After testing, optical (OM) and scanning electron microscopy (SEM) were performed on all the plugs. Digital image analysis was performed to quantitatively assess the erosion of the electrode tips (see Table 2). Out of 8 sets of tested materials, 2 sets failed prematurely: those containing W and Ag electrode tips. Of the remaining 6 sets, 2 had high erosion rates in all four cylinders: Ru and Pt-10% Mi. The remaining 4 were further evaluated.

TABLE 2

Erosion, Polarity, and Position of Candidate Electrodes for Different Materials, after Dynamometer. Testing for 200 Hours.

| Example No. | Material | Cylinder No. | Polarity | Spark Plug No. | Position | % Area Decrease | % Length Decrease |
|---|---|---|---|---|---|---|---|
| 7 | Pure Au | 1 | Pos. | 1 | Intake | −2.30 | −1.75 |
| 8 | Pure Au | 1 | Pos. | 2 | Exhaust | −6.25 | −1.79 |

TABLE 2-continued

Erosion, Polarity, and Position of Candidate Electrodes for Different Materials, after Dynamometer. Testing for 200 Hours.

| Example No. | Material | Cylinder No. | Polarity | Spark Plug No. | Position | % Area Decrease | % Length Decrease |
|---|---|---|---|---|---|---|---|
| 9 | Pure Au | 3 | Neg. | 3 | Intake | 10.71 | 12.17 |
| 10 | Pure Au | 3 | Neg. | 4 | Exhaust | 7.23 | 7.08 |
| 11 | Pure Ir | 1 | Pos. | 1 | Intake | −1.30 | −1.92 |
| 12 | Pure Ir | 1 | Pos. | 2 | Exhaust | −1.19 | −0.91 |
| 13 | Pure Ir | 3 | Neg. | 3 | Intake | 12.66 | 7.62 |
| 14 | Pure Ir | 3 | Neg. | 4 | Exhaust | 2.74 | 3.06 |
| 15 | Ir-40%Rh | 1 | Pos. | 1 | Intake | −8.97 | −0.97 |
| 16 | Ir-40%Rh | 1 | Pos. | 2 | Exhaust | −3.90 | 0.00 |
| 17 | Ir-40%Rh | 3 | Neg. | 3 | Intake | 1.27 | 2.88 |
| 18 | Ir-40%Rh | 3 | Neg. | 4 | Exhaust | −6.40 | −4.90 |
| 19 | Pure Pt | 1 | Pos. | 1 | Intake | 1.25 | −0.94 |
| 20 | Pure Pt | 1 | Pos. | 2 | Exhaust | 12.35 | 8.26 |
| 21 | Pure Pt | 3 | Neg. | 3 | Intake | 7.06 | 4.46 |
| 22 | Pure Pt | 3 | Neg. | 4 | Exhaust | 0.00 | −4.81 |
| 23 | Pure Ru | 1 | Pos. | 1 | Intake | 26.76 | 11.34 |
| 24 | Pure Ru | 1 | Pos. | 2 | Exhaust | 19.72 | 10.58 |
| 25 | Pure Ru | 3 | Neg. | 3 | Intake | 18.18 | 8.57 |
| 26 | Pure Ru | 1 | Neg. | 4 | Exhaust | 10.96 | 6.86 |
| 27 | Pt-10%Ni | 1 | Pos. | 1 | Intake | 10.84 | 6.42 |
| 28 | Pt-10%Ni | 1 | Pos. | 2 | Exhaust | 13.83 | 8.26 |
| 29 | Pt-10%Ni | 3 | Neg. | 3 | Intake | 17.44 | 10.91 |
| 30 | Pt-10%Ni | 3 | Neg. | 4 | Exhaust | 8.64 | 5.56 |

EXAMPLE 31

Statistical analysis has been performed to assess the effect of electrode tip materials and physical properties on the erosion rate of six electrodes (Au, Ir, Ir-40% Rh, Pt, Ru and Pt-10% Ni) after dynamometer testing. Considering the polarity ((+1)-Negative, (−1)-Positive); position ((+1)-Exhaust, (−1)-Intake); and material ((+1)-Pt-10% Ni, (−1)-candidate electrode); as three main factors, gap growth as a response, the main effect and interaction effect have been assessed from the analysis. The erosion mechanism is strongly dependent on the polarity, position and material, and the interaction among three main factors, which can not be explained by simple theory. In general, the material has a strong effect on the erosion rate. Table 3 shows that by replacing Pt-10% Ni electrode with Pt, Ir-40% Rh, Ir or Au, will improve the erosion resistance and durability (negative effect). Candidate electrodes show improvements in durability by ranking are Ir-40% Rh (−8.535)>Pt (−6.045)>Ir (−5.825)>Au (−3.860). Table 3 also shows that by replacing Pt-10% Ni electrode with Ru, will not improve the erosion resistance (positive effect).

Figure 2:
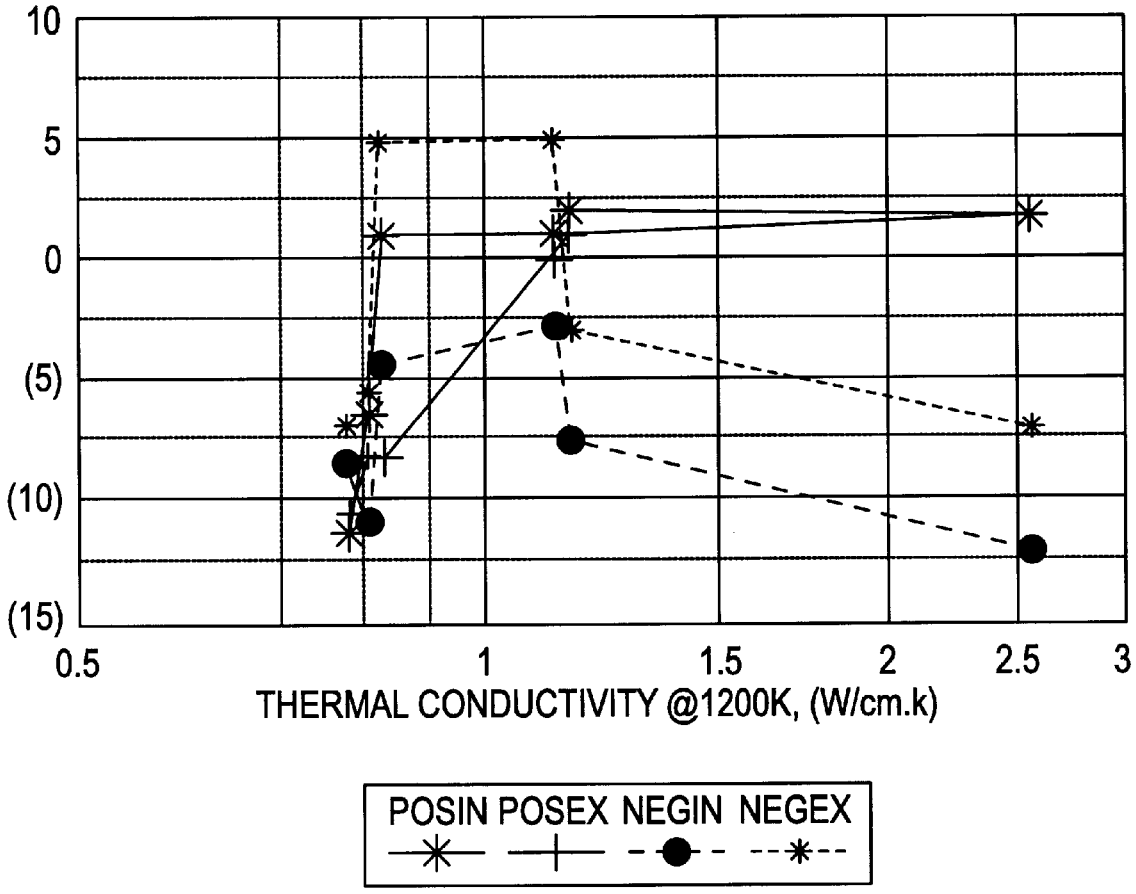
FIG. 2 illustrates the correlation between thermal conductivity of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust)
Figure 3:
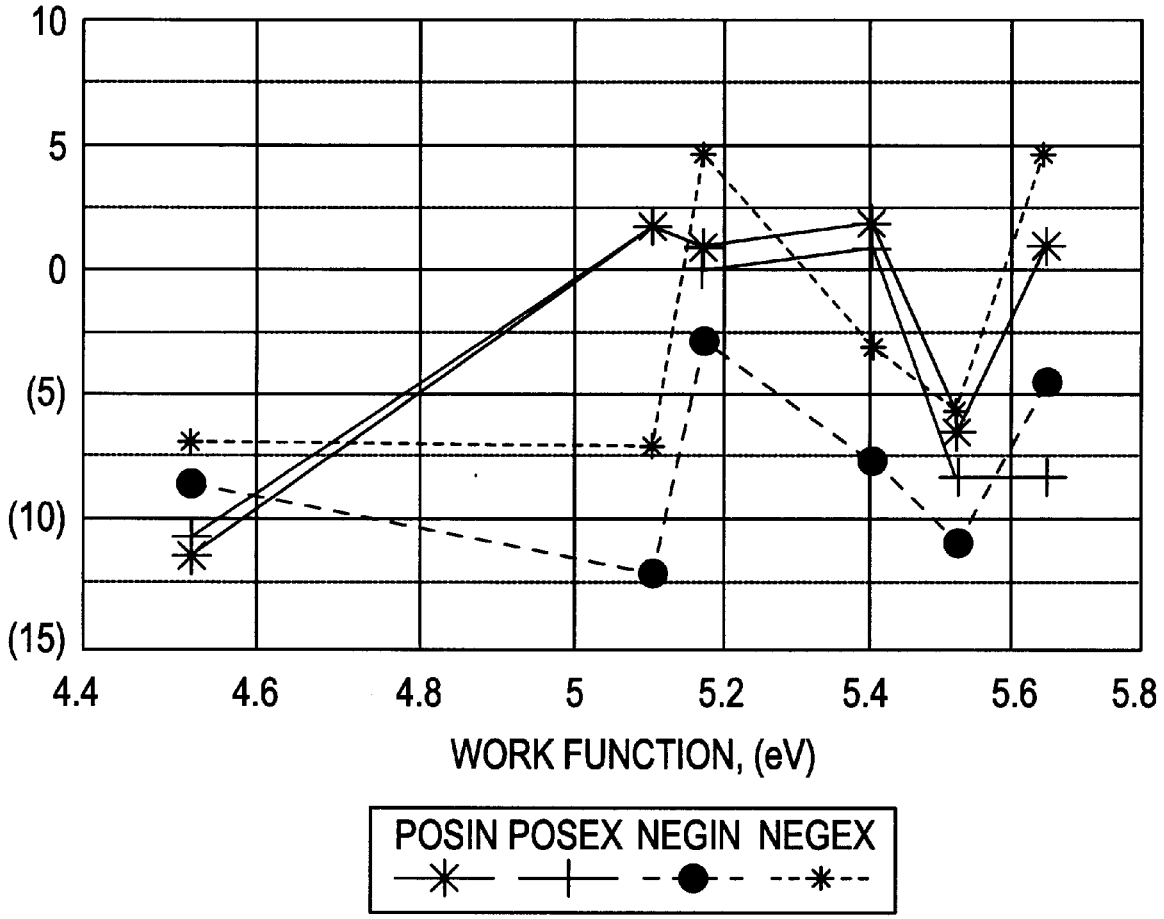
FIG. 3 depicts the correlation between work function of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust)
Figure 4:
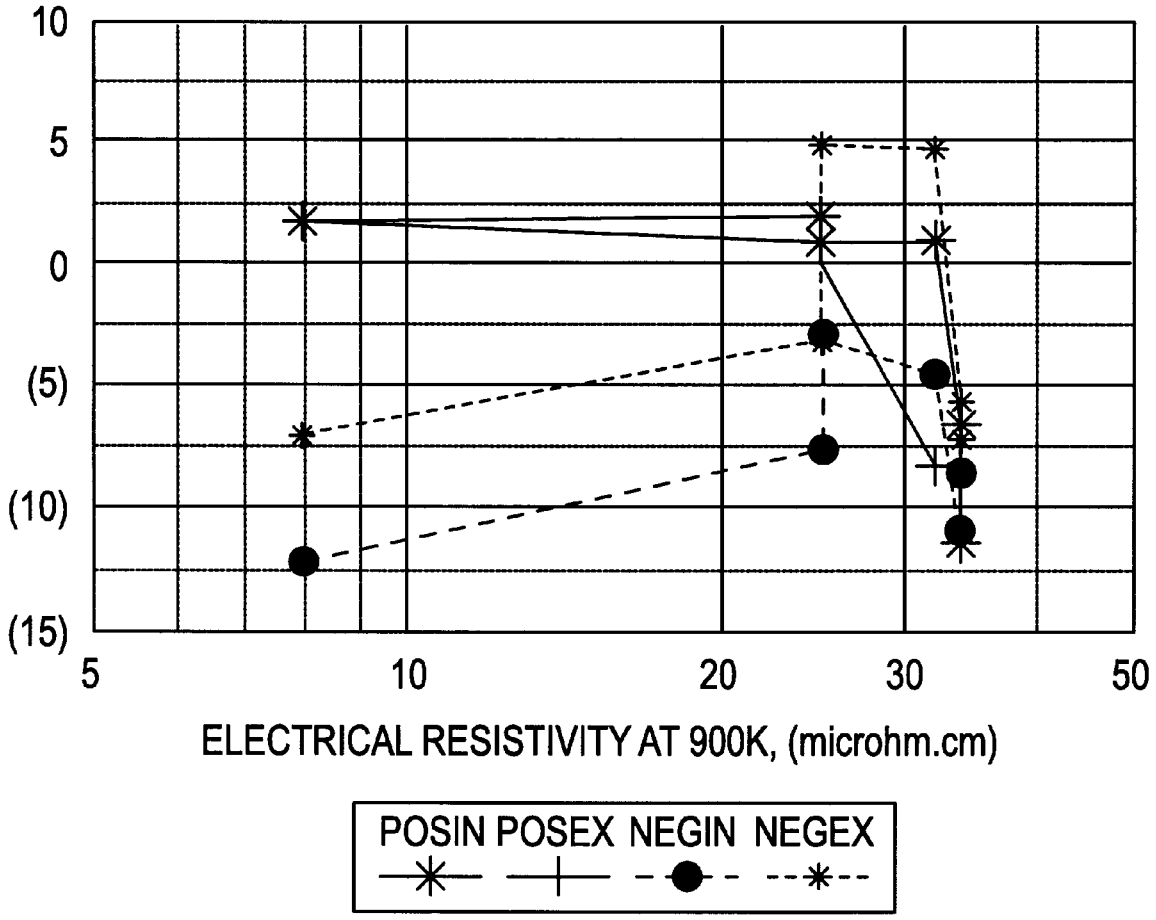
FIG. 4 depicts the correlation between electrical resistivity of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust)
Figure 5:
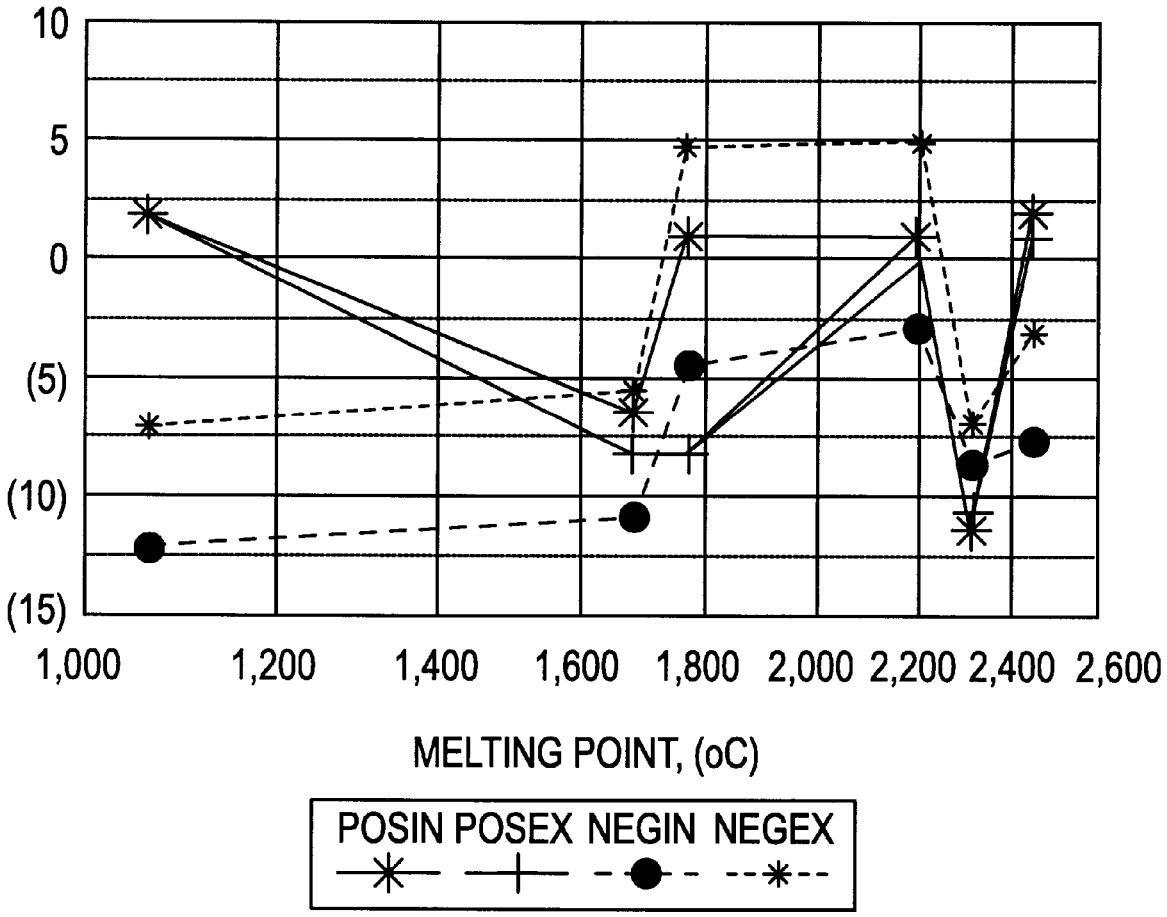
FIG. 5 depicts the correlation between melting point of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust)
Figure 6:
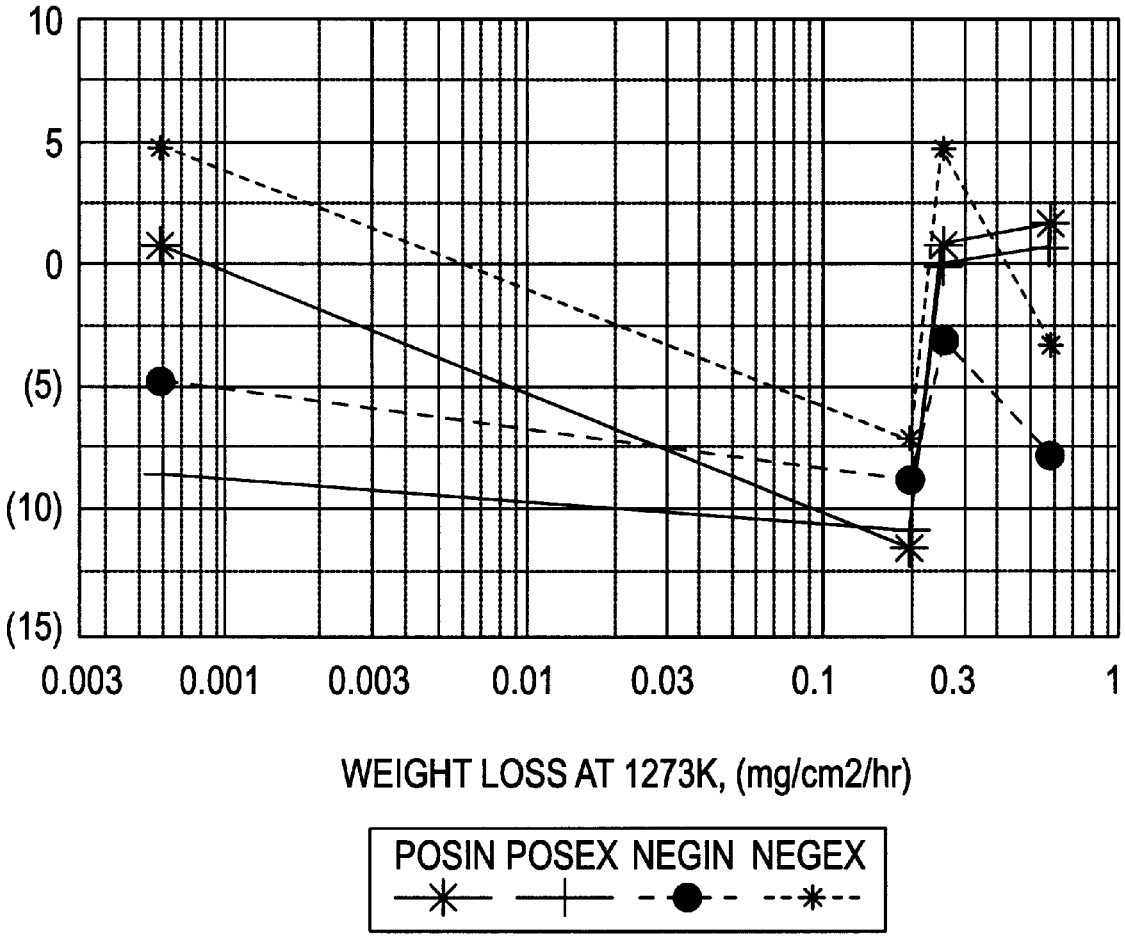
FIG. 6 depicts the correlation between weight loss (oxidation resistance) of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust)
Figure 7:
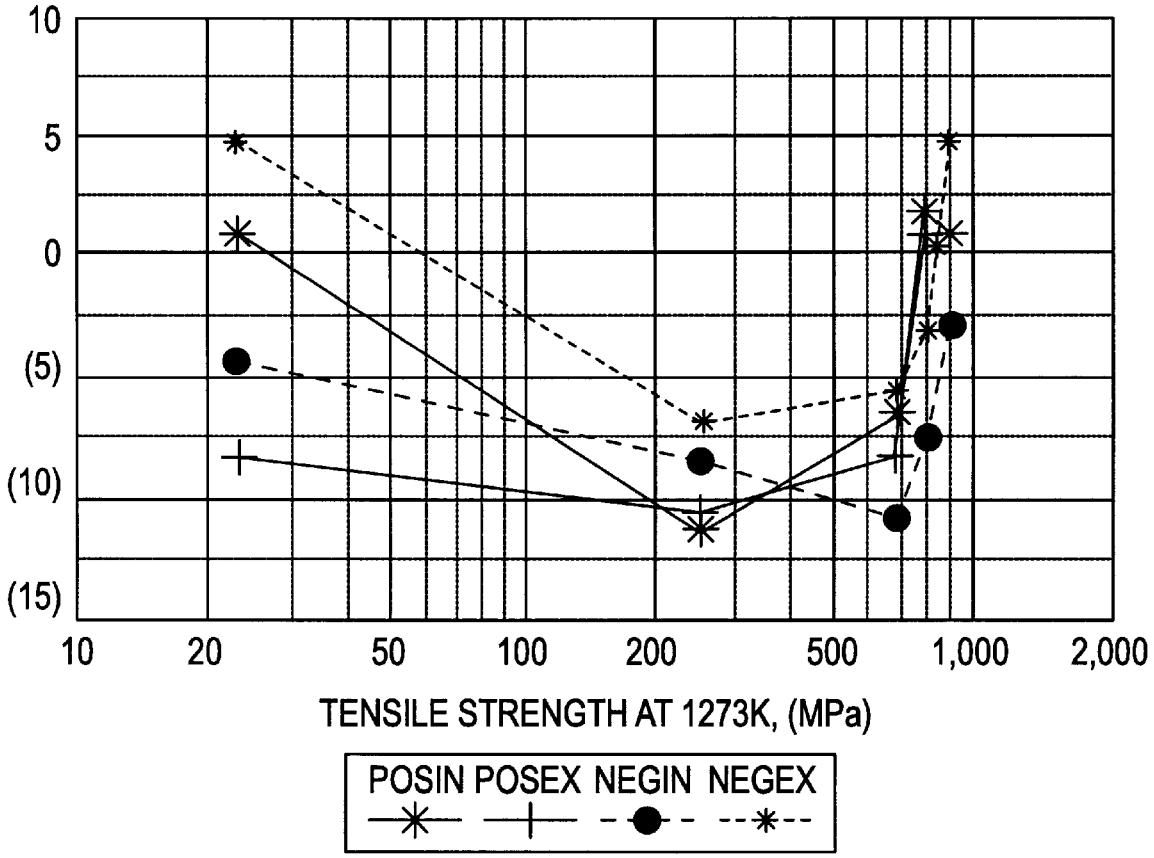
FIG. 7 depicts the correlation between tensile strength of candidate electrodes and erosion (% change in length, negative value means increase in gap growth) for four different conditions: POSIN-positive polarity, intake; POSEX-positive polarity, exhaust; NEGIN-negative polarity, intake; NEGEX-negative polarity, exhaust).

The erosion of electrodes has been correlated with high temperature physical properties (such as work function, thermal conductivity, electrical resistivity and oxidation resistance) of candidate electrodes for four different conditions: positive polarity, intake; positive polarity, exhaust; negative polarity, intake; negative polarity, exhaust). FIG. 2 shows that for positive polarity, a good correlation exists between the erosion resistance and thermal conductivity (1200° K) of candidate electrode. Increasing the thermal conductivity (1200° K) of candidate electrodes increases the erosion resistance and durability. For the negative polarity, to improve the erosion resistance or durability of electrodes, thermal conductivity (1200° K) must be within the range of 0.8 to 1.3 (W/cm.° K) to achieve the optimum performance. FIG. 3 shows that for the correlation between the erosion resistance and work function of candidate electrode is very complicated. Increasing the work function of candidate electrodes increases the erosion resistance and durability for work function <5.2 eV. For work functions >5.2 eV, increasing the work function of candidate electrode (except Pt) decreases the erosion resistance. FIG. 4 shows that a good correlation exists between the erosion resistance and electrical resistivity (900° K) of candidate electrode (except Au). Increasing in electrical resistivity (900° K) of candidate electrodes decreases the erosion resistance and durability. FIG. 5 shows that there is no correlation between the erosion resistance and melting point of candidate electrode if the melting point of the material is higher than the operating temperature of the engine. FIG. 6 shows that the correlation between the erosion resistance and oxidation resistance (weight loss at 1273° K) of precious metal is very complicated. The nature of metal-oxide rather than the metal itself, polarity, and position play important roles in the erosion mechanism. FIG. 7 shows that there is a good correlation between the erosion resistance and tensile strength (1273° K, except Pt-10% Ni). Increasing the high temperature tensile strength (1273° K) increases the erosion resistance. The high erosion of Pt-10% Ni is due to the weight loss from the selective oxidation of nickel in this alloy.

In view of the foregoing observations and calculations, apparently a spark plug electrode tip consisting of iridium and rhodium is essential elements of the erosion resistant alloys of the instant invention. Moreover, the test data indicates that iridium, and rhodium significantly increases the erosion resistance of spark plugs.

TABLE 3

The Effect of Polarity, Position and Material on the Erosion of Electrodes.
Material: (+1) - Pt-10 % Ni, (−1) - Pt;
Polarity: (+1) - Negative, (−1) - Positive;
Position: (+1) - Exhaust, (−1) - Intake.

| Material | Effect | Effect Estimate |
|---|---|---|
| Ir-40 % Rh | 3 Material | −8.535 |
| | 12 | 3.985 |
| | 2 Position | 2.580 |

TABLE 3-continued

The Effect of Polarity, Position and Material on the Erosion of Electrodes.
Material: (+1) - Pt-10 % Ni, (−1) - Pt;
Polarity: (+1) - Negative, (−1) - Positive;
Position: (+1) - Exhaust, (−1) - Intake.

| Material | Effect | Effect Estimate |
|---|---|---|
| | 23 | −0.825 |
| | 13 | −0.710 |
| | 123 | −0.390 |
| | 1 Polarity | −0.185 |
| Pure Pt | 12 | 6.415 |
| | 3 Material | −6.045 |
| | 123 | −2.820 |
| | 13 | −2.365 |
| | 1 Polarity | 1.470 |
| | 2 Position | 0.895 |
| | 23 | 0.860 |
| Pure Ir | 3 Material | −5.825 |
| | 1 Polarity | −3.825 |
| | 12 | 3.190 |
| | 13 | 2.930 |
| | 2 Position | 1.765 |
| | 123 | 0.405 |
| | 23 | −0.010 |
| Pure Au | 1 Polarity | −6.145 |
| | 13 | 5.250 |
| | 3 Material | −3.860 |
| | 12 | 3.060 |
| | 2 Position | 2.160 |
| | 123 | 0.535 |
| | 23 | −0.405 |
| Pure Ru | 13 | −2.070 |
| | 12 | 2.035 |
| | 123 | 1.560 |
| | 3 Material | 1.550 |
| | 2 Position | 1.495 |
| | 1 Polarity | 1.175 |
| | 23 | 0.260 |

Having thus described the invention in rather full detail, it will be understood that such detail need not be strictly adhered to but that various changes and modifications may suggest themselves to one skilled in the art, all falling within the scope of the invention as defined by the subjoining claims.

We claim:

1. A spark plug comprising:

(a) an insulator shell, a center electrode, (b) a center electrode inside the insulator shell such that one end of the center electrode protrudes from the insulator shell, (c) a metal shell exterior to the insulator shell, (d) a side ground electrode having one end coupled to the metal shell and the other end facing the protruding end of the center electrode to form a spark discharge gap between the center electrode and the side ground electrode, and (e) a noble metal tip on at least one of the side ground electrode or the center electrode, located at the spark discharge gap, that is an iridium-based alloy including rhodium in an amount of greater than 30 weight percent and less than 60 weight percent.

2. A spark plug according to claim 1 having a noble metal tip on the center electrode.

3. A spark plug according to claim 1 having a noble metal tip on the side ground electrode.

4. A spark plug according to claim 1 having noble metal tips on the center electrode and on the side ground electrode.

5. A spark plug according to claim 1 wherein said noble metal tip is joined said center electrode, said side ground electrode, or both, by brazing, resistance welding, or laser welding.

6. A spark plug according to claim 1 wherein said iridium-based alloy includes rhodium in an amount of about 40 weight percent.

7. A spark plug according to claim 1 wherein said iridium-based alloy includes rhodium in an amount of 40 weight percent.

8. A spark plug according to claim 1 wherein said iridium-based alloy consists essentially of iridium and rhodium.

9. A spark plug according to claim 8 wherein iridium is present in said iridium-based alloy in an amount of about 60 weight percent and rhodium is present in an amount of about 40 weight percent.

10. A spark plug according to claim 1 wherein said iridium-based alloy consists of iridium and rhodium.

11. A spark plug according to claim 10 wherein iridium is present in said iridium-based alloy in an amount of 60 weight percent and rhodium is present in an amount of 40 weight percent.

12. A spark plug according to claim 1 wherein said iridium-based alloy has:

(1) a thermal conductivity of 0.7 to 1.5 W/cm.K at 1200° K, (2) a work function of 4.5 to 5.4 eV, (3) an electrical resistivity of less than 35 micro ohm.cm at 900° K, (4) a weight loss of less than 0.5 $mg/cm^2/hr$ at 1273° K (5) a tensile strength of greater than 100 Mpa at 1273° K, and (6) no low-melting eutectic formed with lead.

* * * * *